US008527249B2

(12) United States Patent
Jamison et al.

(10) Patent No.: US 8,527,249 B2
(45) Date of Patent: Sep. 3, 2013

(54) SYSTEM AND METHOD FOR OPTIMIZING DRILLING SPEED

(75) Inventors: Dale E. Jamison, Humble, TX (US); Kevin P. Paylow, Tomball, TX (US); Robert L. Williams, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 712 days.

(21) Appl. No.: 12/710,445

(22) Filed: Feb. 23, 2010

(65) Prior Publication Data

US 2011/0203845 A1 Aug. 25, 2011

(51) Int. Cl.
*G06G 7/58* (2006.01)

(52) U.S. Cl.
USPC ..... 703/10

(58) Field of Classification Search
USPC ..... 703/9, 10; 166/250.1, 250.07, 254.2, 166/308.1, 358
See application file for complete search history.

(56) References Cited

U.S. PATENT DOCUMENTS

| | | | | |
|---|---|---|---|---|
| 5,730,234 | A | 3/1998 | Putot | 175/50 |
| 6,220,087 | B1 * | 4/2001 | Hache et al. | 73/152.46 |
| 7,044,239 | B2 | 5/2006 | Pinckard et al. | |
| 2004/0092573 | A1 | 5/2004 | Robl et al. | 514/423 |
| 2005/0257611 | A1 | 11/2005 | Fogal et al. | 73/152.22 |
| 2006/0116823 | A1 * | 6/2006 | Griffiths | 702/6 |
| 2011/0153296 | A1 * | 6/2011 | Sadlier et al. | 703/7 |

FOREIGN PATENT DOCUMENTS

| | | |
|---|---|---|
| WO | WO 02/38915 A2 | 5/2002 |

OTHER PUBLICATIONS

Sadlier et al. (U.S. Appl. No. 61/288,662), filed Dec. 21, 2009.*
Halliburton, BAROiD Fluid Services, DFG (TM) Software With DrillAhead (R) Hydraulics Module, (C) Apr. 2007.
Hemphill, Terry et al., "Optimization of Rates of Penetration in Deepwater Drilling, Identifying the Limits", AAPG: Selections from the Society of Petroleum Engineers, (C) SPE 2001.
Calderoni, A. et al., "Balanced Pressure Drilling With Continuous Circulation Using Jointed Drill Pipe—Case History, Port Fouad Marine Deep 1, Exploration Well Offshore Egypt", Presented at 2006 SPE Annual Technical Conference and Exhibition held in San Antonio Texas, U.S.A., Delivered Sep. 24-27, 2006.
Freundenrich, Craig, Ph.D. "How Oil Drilling Works", http://www.howstuffworks.com/oil-drilling.htm/printable, Printed Jun. 9, 2009.
Wikipedia (English), "Oil platform", http://en.wikipedia.org/wiki/Oil_platform, Printed Jun. 9, 2009.
Wikipedia (English), "Drilling rig", http://en.wikipedia.org/wiki/Driiling_rig, Printed Jun. 9, 2009.
Wikipedia (English), "Oil well", http://en.wikipedia.org/wiki/Oil_well, Printed Jun. 9, 2009.

(Continued)

*Primary Examiner* — David Silver
*Assistant Examiner* — Andre Pierre Louis
(74) *Attorney, Agent, or Firm* — John Wustenberg; Conley Rose, P.C.

(57) ABSTRACT

This invention presents various embodiments, including a system and a method, in which pressure-while-drilling data is gathered at a drilling rig and compared to modeled ECD pressure data related to the bore hole. The actual and modeled data are statistically analyzed to generate standard deviation data, which is used to infer information about how rapid a rate of penetration may safely be employed to optimize drilling results.

20 Claims, 7 Drawing Sheets

(56) References Cited

OTHER PUBLICATIONS

Halliburton, Sperry Drilling Services, "PWD (Pressure-While-Drilling) Sensor", (C) 2007.
Halliburton, Geobalance (TM), "Precise Pressure Control Services", Printed Jun. 9, 2009.
Halliburton, Sperry Drilling Services, "GeoBalance (R) Optimized Pressure Drilling Services", (C) Jan. 2009.
Universal Solutions S.A.E., "Managed Pressure Drilling with the ECD Reduction Tool", Abstract May 22, 2005.
PCT/GB2011/000248, International Search Report, 3 pages (Apr. 18, 2012).

* cited by examiner

SYSTEM AND METHOD FOR OPTIMIZING DRILLING SPEED

CROSS-REFERENCE TO RELATED APPLICATIONS

The present invention is not related to any co-pending applications.

FIELD OF THE INVENTION

The present invention relates to a system and method for optimizing the rate of penetration when drilling into a geological formation by utilizing data about actual and modeled borehole pressure values to determine the fastest rate of penetration at which drilling can occur safely.

DESCRIPTION OF THE RELATED ART

Oil and natural gas are fossil fuels that are found in certain geological formations. They are crucial as energy sources, and are used for many other chemical applications. Because of the high demand for oil and natural gas, elaborate techniques have been developed to drill into the earth's surface to reach deposits of oil and natural gas. Many times these deposits are thousands, or even tens of thousands, of feet below the surface. Also, deposits are often located beneath the ocean floor.

Once a prospective deposit of oil or natural gas has been located a drilling rig is set up to form a borehole into the formation. The drilling rig includes power systems, mechanical motors, a rotary turntable drill, and a circulation system that circulates fluid, sometimes called "mud", throughout the borehole. The fluid serves to remove materials as the drill bit loosens them from the surrounding rock during drilling and to maintain adequate borehole pressure. Needless to say, a drilling rig is a complex and expensive piece of machinery.

The drilling itself takes place by using a drill bit at the bottom of the pipe (drill string) and transmitting rotary motion to the bit using a multi-sided pipe known as a "kelly" with a turntable. As drilling progresses, mud circulates through the pipe into the borehole and bits of rock are removed from the hole by the circulating mud. New sections are added to the pipe progressively as the drilling continues. The drilling will be completed when a desired depth is reached, at which point various tests can be conducted to precisely locate and isolate the depth of the formation housing the desired hydrocarbon deposits.

However, the drilling process is extremely expensive and time consuming. The operation of an offshore rig can easily cost $500,000 per day. Therefore, small time savings can lead to huge monetary savings. Drilling faster of course saves time because the drilling time would be reduced, leading to "production" phase oil wells more quickly.

It is important to manage borehole pressure properly during drilling, to ensure that the drilling process leads to a stable hole. If there is too much fluid pressure during drilling, there may be insufficient margins between formation fracture and pore pressures, which may result in damage to the formation and production difficulties. If the pressure is low, a "blowout" can occur. This scenario is dangerous and potentially expensive to cure. However, there is an incentive to drill as quickly as possible, because to do so saves time and thus expense. However, drilling faster makes it more difficult to properly respond to borehole pressure changes. It is difficult to determine a rate of penetration that is optimally fast, and yet safe.

SUMMARY OF THE INVENTION

The invention uses real-time information about pressure obtained while drilling into a geological formation and analyzes it in combination with modeled equivalent circulating density (ECD) data for the drilling process based on statistical analysis to estimate a safe rate of penetration. ECD is the effective density exerted by a circulating fluid (the mud) against the formation that takes into account the pressure drop due to pressure differential between the borehole and the surface. Equivalent circulating density may be calculated from an annulus pressure (pressure of the circulating mud) measurement take at a selected position in the annulus based on the familiar expression for hydrostatic pressure of a column of fluid:

$$p=\rho gh$$

p represents the pressure, ρ represents the fluid density, g represents gravity, and h represents the vertical depth of the position at which the pressure is measured. Solving the above expression for density provides the following expression for equivalent circulating density:

$$\mathrm{ECD}=p/gh$$

ECD may either be determined by the use of sensors, or modeled using a computer model. In any event, it reflects the pressure the mud places on the borehole as drilling continues.

The purpose of the invention is to maximize productivity of drilling efforts. Productivity is generally determined by the ratio of rig time (time spent drilling) to NPT (Non-Productive Time); when drilling a well it is desirable to maximize this ratio because there is a cost associated with NPT whereas only rig time is a productive and useful way to spend money. Furthermore, because costs are associated with either type of time, it is desirable to minimize both forms of time, and one way to do this is to have a higher rate of penetration.

One embodiment uses selective drilling activity compression/expansion (SDACE) of historical real time data coupled with a look-ahead-of the-bit drilling simulator such as Halliburton's™ DFG™ Software with DrillAhead® Hydraulics Module. By engaging in mathematical and statistical analysis to combine these two sources of information about an ongoing drilling project, the invention can develop projections about what ECD values will be the maximum tolerable ECD values for the ongoing drilling process. Based upon what is practical for a given drilling process, the estimates can then be used to increase rate of penetration. This will then allow increased productivity by allowing a safe increase in rate of penetration.

According to one embodiment of the invention, there is provided: A method for optimizing drilling rate of penetration and performance when drilling into a geological formation, comprising the steps of: gathering real-time PWD (pressure while drilling) data from a drilling rig sensor such as a MWD (measurement while drilling) bottomhole assembly, acquiring modeled ECD (equivalent circulating density) data for the drilling process, calculating the standard deviation of the differences of said real-time PWD and said modeled ECD data; calculating a set of predicted maximum tolerable ECD data for the drilling process based on the calculated deviation, and determining the rate of penetration of the drilling rig drill string based on the maximum tolerable ECD data of the drilling process.

According to another embodiment of the invention, there is provided: A system for optimizing drilling rate of penetration and performance when drilling into a geological formation, comprising: a gathering unit for gathering real-time PWD (pressure while drilling) data from a drilling rig sensor such as a MWD (measurement while drilling) bottomhole assembly, an acquiring unit for acquiring modeled ECD (equivalent circulating density) data for said drilling process, a calculating unit for calculating the standard deviation of the differences of said real-time PWD and said modeled ECD data, a calculating unit for calculating a set of predicted maximum tolerable ECD data for said drilling process based on the calculated deviation, and a controlling unit for controlling the rate of penetration of the drilling rig drill string based on the maximum tolerable ECD data of the drilling rig borehole.

According to another embodiment of the invention, there is provided: An apparatus for optimizing drilling rate of penetration and performance when drilling into a geological formation, comprising: means for gathering real-time PWD (pressure while drilling) data from a drilling rig sensor such as a MWD (measurement while drilling) bottomhole assembly, means for acquiring modeled ECD (equivalent circulating density) data for said drilling process, means for calculating the standard deviation of the differences of said real-time PWD and said modeled ECD data, means for calculating a set of predicted maximum tolerable ECD data for said drilling process based on the calculated deviation, means for determining the rate of penetration of the drilling rig drill string based on the maximum tolerable ECD data of the drilling process.

According to another embodiment of the invention, there is provided: Computer readable media, having instructions stored thereon, wherein the instructions, when executed by a processor, perform computing functions designed for optimizing drilling rate of penetration and performance when drilling into a geological formation, comprising the steps of: gathering real-time PWD (pressure while drilling) data from a drilling rig sensor such as a MWD (measurement while drilling) bottomhole assembly, acquiring modeled ECD (equivalent circulating density) data for the drilling process, calculating the standard deviation of the differences of said real-time PWD and said modeled ECD data, calculating a set of predicted maximum tolerable ECD data for the drilling process based on the calculated deviation, and determining the rate of penetration of the drilling rig drill string based on the maximum tolerable ECD data of the drilling process.

DETAILED DESCRIPTION OF THE INVENTION

In the following description, numerous specific details are set forth in order to provide a thorough understanding of the present invention. It will be apparent, however, to one skilled in the art, that the present invention may be practiced without some or all of these specific details. In other instances, well known process steps have not been described in detail in order not to unnecessarily obscure the present invention.

In a drilling operation, tremendous pressures are generated in the borehole, which must be managed carefully. A careful balance must be struck between drilling as rapidly as is feasible, which saves precious time, and preserving the integrity of the drilling operation, by preventing fracturing or a blowout. One of the aims of the invention is to be of use in helping those involved in drilling to make decisions that will help determine an optimized drilling rate of penetration.

Figure 1:
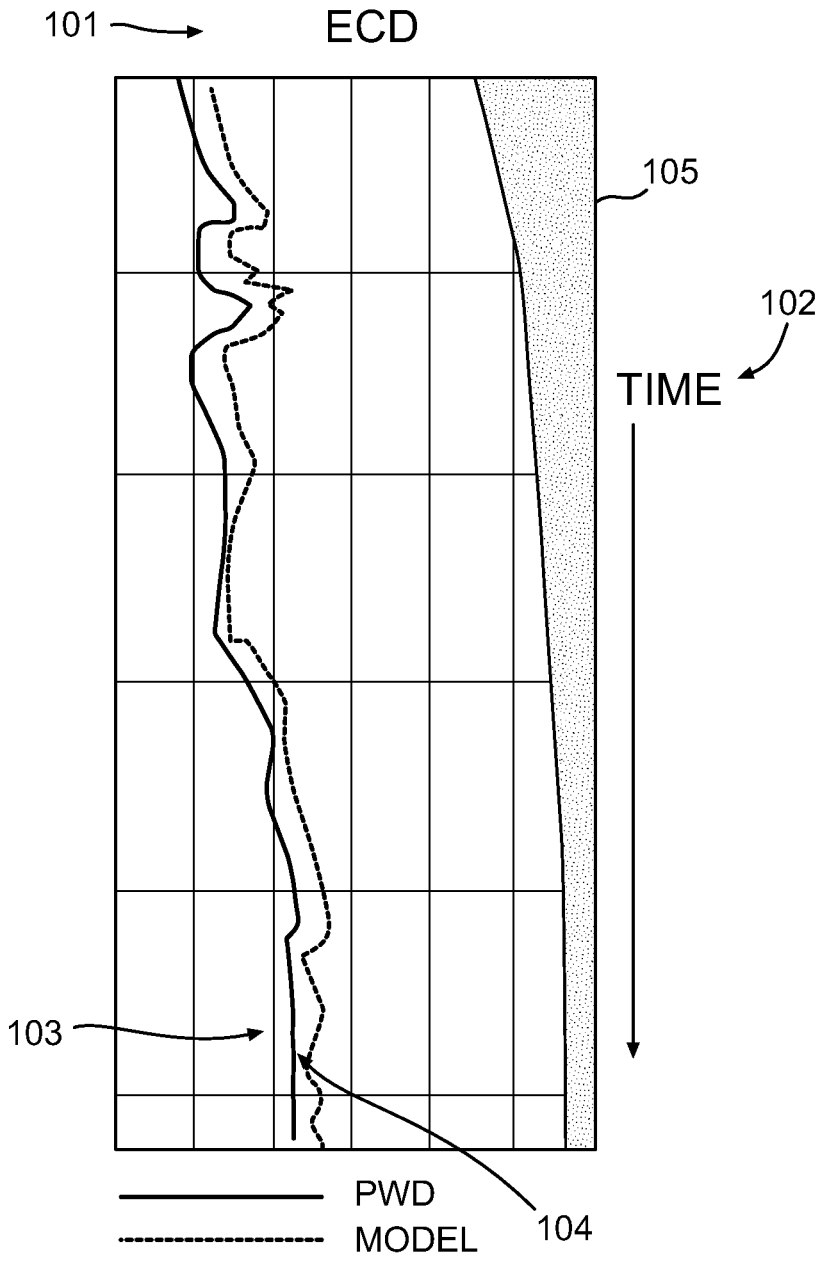
FIG. 1 is a graph showing ECD values vs. time corresponding with measured PWD (pressure-while-drilling) as well as a model and how they compare to the fracture gradient.

The invention does this optimization by using real-time PWD data 103 from the well, which is usually displayed in a strip chart as in FIG. 1. Such a chart plots ECD 101 data, which are Equivalent Circulating Density, a way of measuring Pressure-While-Drilling.

Figure 6:
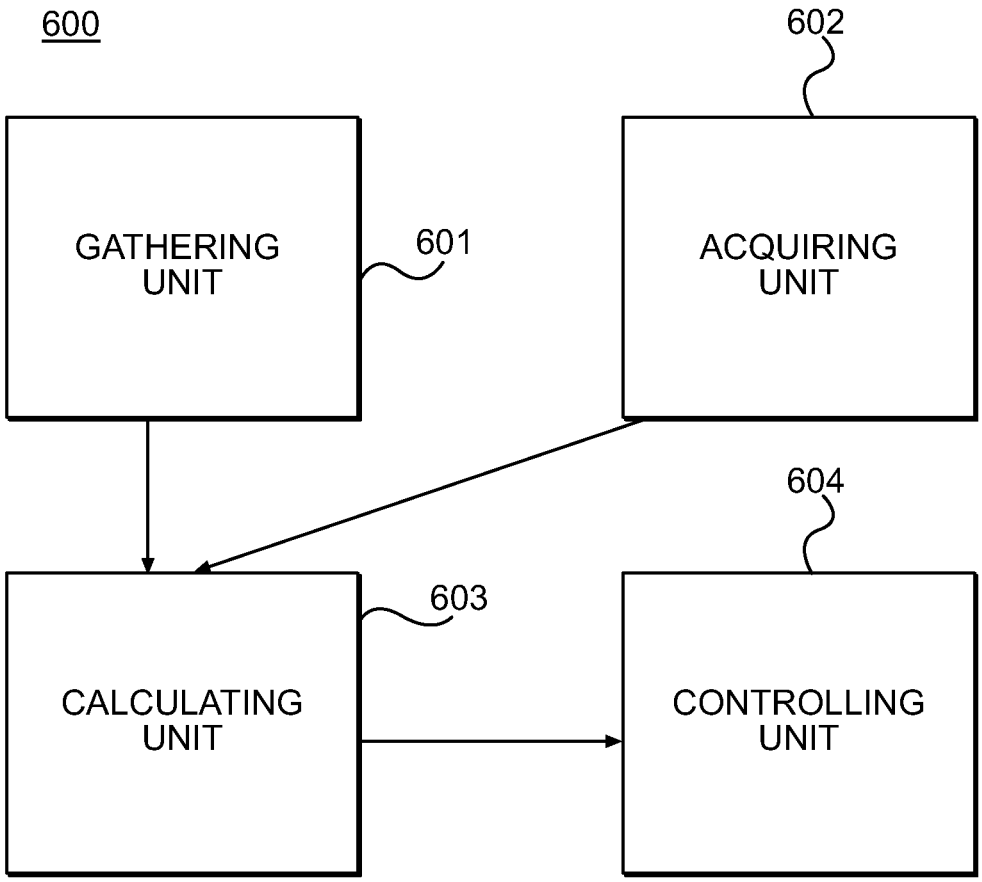
FIG. 6 is a block diagram of a computer system of an embodiment.

As illustrated in FIG. 6, which shows a block diagram of a computer system embodiment, gathering unit 601 gathers real-time PWD data from a drilling rig, (through a downhole sensor such as an MWD assembly, for example) and an acquiring unit 602 acquires modeled ECD data for the drilling rig. An example way to acquire the modeled ECD data is to use modeling software such as DFG™ Software with DrillAhead® Hydraulics Module from Halliburton™, which will provide "look-ahead" modeling in which future drilling conditions are predicted.

Once the gathering unit 601 and the acquiring unit perform their tasks, the information they provide may be used by a calculating unit 603 for calculating the standard deviation of the differences of said real-time PWD and said modeled ECD data and calculating a set of predicted maximum tolerable ECD data for said drilling process based on the calculated deviations as described in greater detail below. Finally, this information is transmitted to a controlling unit 604 for controlling the drilling rig based on the maximum tolerable ECD data of the drilling process.

Returning to FIG. 1, the fracture gradient 105 is clearly far to the right, i.e. higher in ECD value of both the PWD curve 103 and model curve 104. The inventors' work has shown that, using the standard deviation of the measured PWD and modeled ECD, estimates can be made as to how close to the fracture gradient one can reliably operate during a drilling process. The smaller the standard deviation, the more confidence one has operating near the fracture gradient.

More specifically, the calculating unit can use the traditional definition of standard deviation:

$$\sigma = \sqrt{\frac{1}{N}\sum_{i=1}^{N} x_i - \bar{x})^2} \qquad \text{Equation 1}$$

In this Equation 1:, Xbar is the average of the PWD data and $X_i$ are the discrete-model results for some time period. Once the standard deviation is computed and a sense of the standard error is established, one can determine the upper limits of the optimization simulations. Using equation 2:

$$ECD_{maximum} = FG - (RF * \sigma + SF) \qquad \text{Equation 2}$$

Fracture Gradient data can come from multiple sources. Often one will know the fracture gradient based on offset wells and well testing done on them. Additionally, there are numerous programs that attempts to model and predict pore pressure and fracture gradient based on various properties such as rock type, porosity, temperature etc. One good reference on the prediction of fracture gradients is: Pressure Regimes in Sedimentary Basins and Their Prediction by Alan R. Huffman, Glenn L. Bowers, American Association of Petroleum Geologists, American Association of Drilling Engineers, American Association of Petroleum Geologists, American Association of Drilling Engineers Houston Chapter.

In Equation 2, RF represents a reliability factor and SF represents a safety factor. The safety factor depends on many factors including the risk (cost) of exceeding ECD and mitigating costs. The reliability factor is based on the number of standard deviations. If we assume a normal distribution then for a RF=1 about 68% of the values would fall into the range. For a RF=2, about 95% of the values would fall into the range and for RF=3 about 99%. A reasonable SF coupled with an acceptable reliability factor would ensure that ECD would stay below the fracture gradient by a safe margin. The user of a given embodiment chooses RF and SF to reflect the margin of error that he or she considers acceptable. In real-time the standard deviation, σ, can be calculated based on a previous "window" of drilling using one of several methods such as a moving average over the well, current bit run, or current formation. Any instability in the standard deviation could immediately be factored into the optimization process by a recalculation of the $ECD_{max}$.

Figure 2:
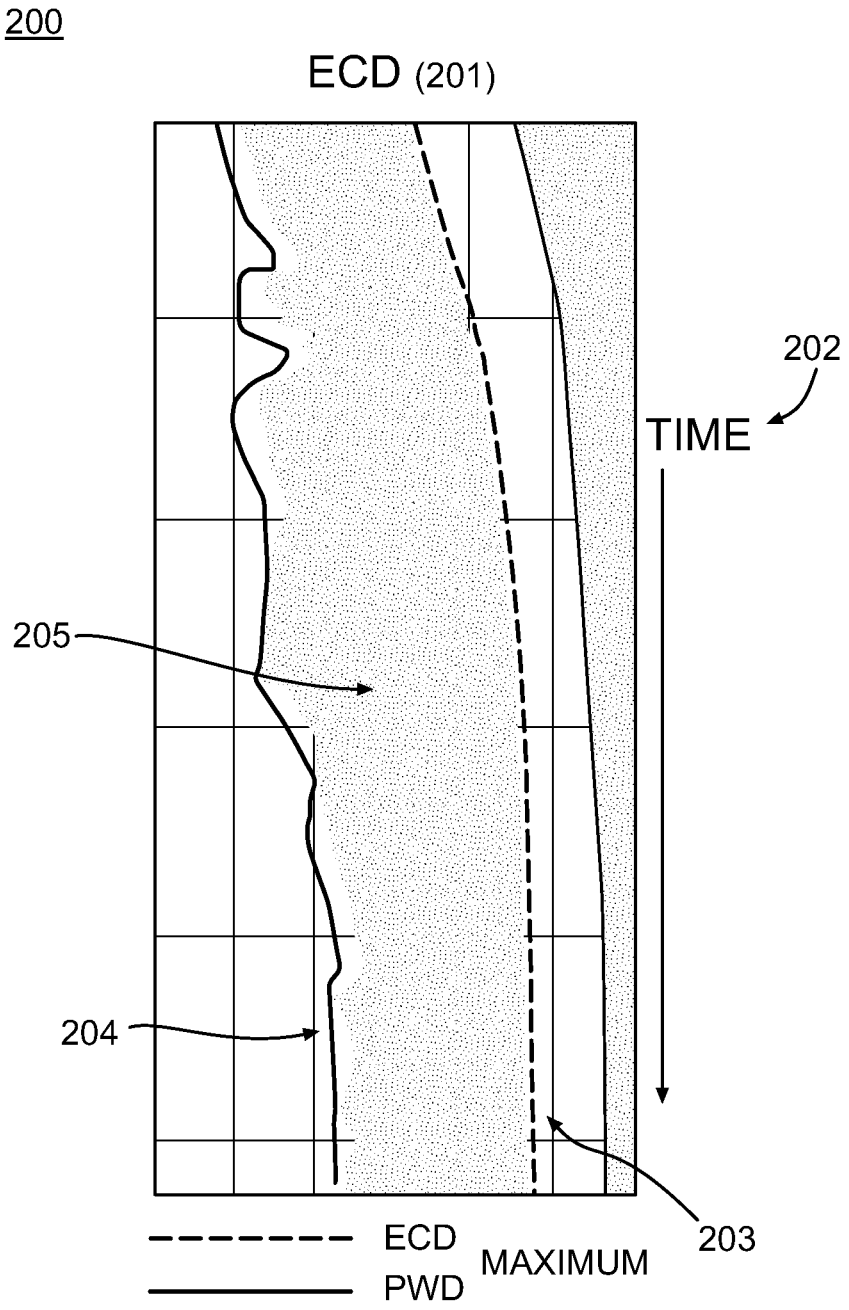
FIG. 2 is a graph showing ECD values vs. time corresponding with measured PWD (pressure-while-drilling) as well as a model and how they can be used to estimate a maximum ECD curve that remains below the fracture gradient.

FIG. 2 shows the calculated $ECD_{max}$ 203 and the safe operating range with a safety factor included. Once again, it is ECD 201 vs. time 202, with PWD recorded 204. The shaded area 205 shows the range of opportunity to increase ECD and maximize the ROP (rate of penetration).

Cuttings generated during the drilling process must be transported to the surface by the drilling fluid in the annulus. The faster the ROP, the higher the cuttings concentration becomes in the drilling fluid. As the cuttings concentration increases, the average density of the drilling fluid increases as well. The increase in drilling fluid density will cause the hydrostatic component of the pressure the drilling fluid exerts on the formation to increase as well. In addition to the density increase there will be an effective viscosity increase as well. The viscosity increase will manifest into higher wellbore pressures as well. Hence, higher ROP leads to greater ECD for both of these reasons. Historically, a cuttings concentrations limit of about 5% has been recommended for vertical wells. As wells have become typically more extended reach, average cuttings concentrations recommendations have been reduced to less than 3%.

In real time historical data, not all activities can be or should be subjected to time compression or expansion. For example, connection times are constrained by the physical time required to handle the pipes. Drilling on the other hand can often be sped up or slowed down; hence the term "selective time compression". Also, various elements of the drilling process such as "pump and rotate" for hole-cleaning as well as other drilling elements can have different amounts of time compression and/or expansion throughout the simulation for various intervals.

In the following table of historical real time data, an example with two drilling activities are shown. In this case drilling activity is followed by pipe connection activity then again by drilling. It is important to note that large amounts of data are typically recorded in small time increments; typically up to once per second. In the following, these elements are combined and represented together for simplicity.

TABLE 1

In this method one can select individual time elements and artificially expand or compress the time a specific activity required. Thus, one can effectively change the ROP of the historical data in preparation of running it through a simulator to predict ECD, had the operator drilled at the faster rate. In this example the connection time remains constant while ROP is doubled. The modified time basis data would then be the following. Note that ROP may be determined by means such as a sensor installed on the drill bit which returns the rate at which drilling successfully occurs.

| Elapsed Time | Activity | Depth | PWD | ROP |
|---|---|---|---|---|
| 00:00:00 | Drilling | 1000 | 12 | |
| 00:20:00 | Drilling | 1050 | 12 | 150 |
| 00:40:00 | Drilling | 1100 | 12 | 150 |
| 00:40:01 | Connection | 1100 | 11.5 | 0 |
| 00:45:00 | Connection | 1100 | 11.5 | 0 |
| 00:45:01 | Drilling | 1100 | 12 | 150 |
| 00:65:00 | Drilling | 1150 | 12 | 150 |
| 00:85:00 | Drilling | 1200 | 12 | 150 |

TABLE 2

The DAH simulator uses this modified historical data to recreate a real time comparison of modeled ECD to historical PWD data. In this case the predicted ECD would be right and could be plotted in real time with the actual PWD and modeled ECD as shown in FIG. 3 at 304.

| Elapsed Time | Activity | Depth | ROP |
|---|---|---|---|
| 00:00:00 | Drilling | 1000 | |
| 00:10:00 | Drilling | 1050 | 300 |
| 00:20:00 | Drilling | 1100 | 300 |
| 00:20:01 | Connection | 1100 | 0 |
| 00:25:00 | Connection | 1100 | 0 |
| 00:25:01 | Drilling | 1100 | 300 |
| 00:35:00 | Drilling | 1150 | 300 |
| 00:45:00 | Drilling | 1200 | 300 |

Figure 3:
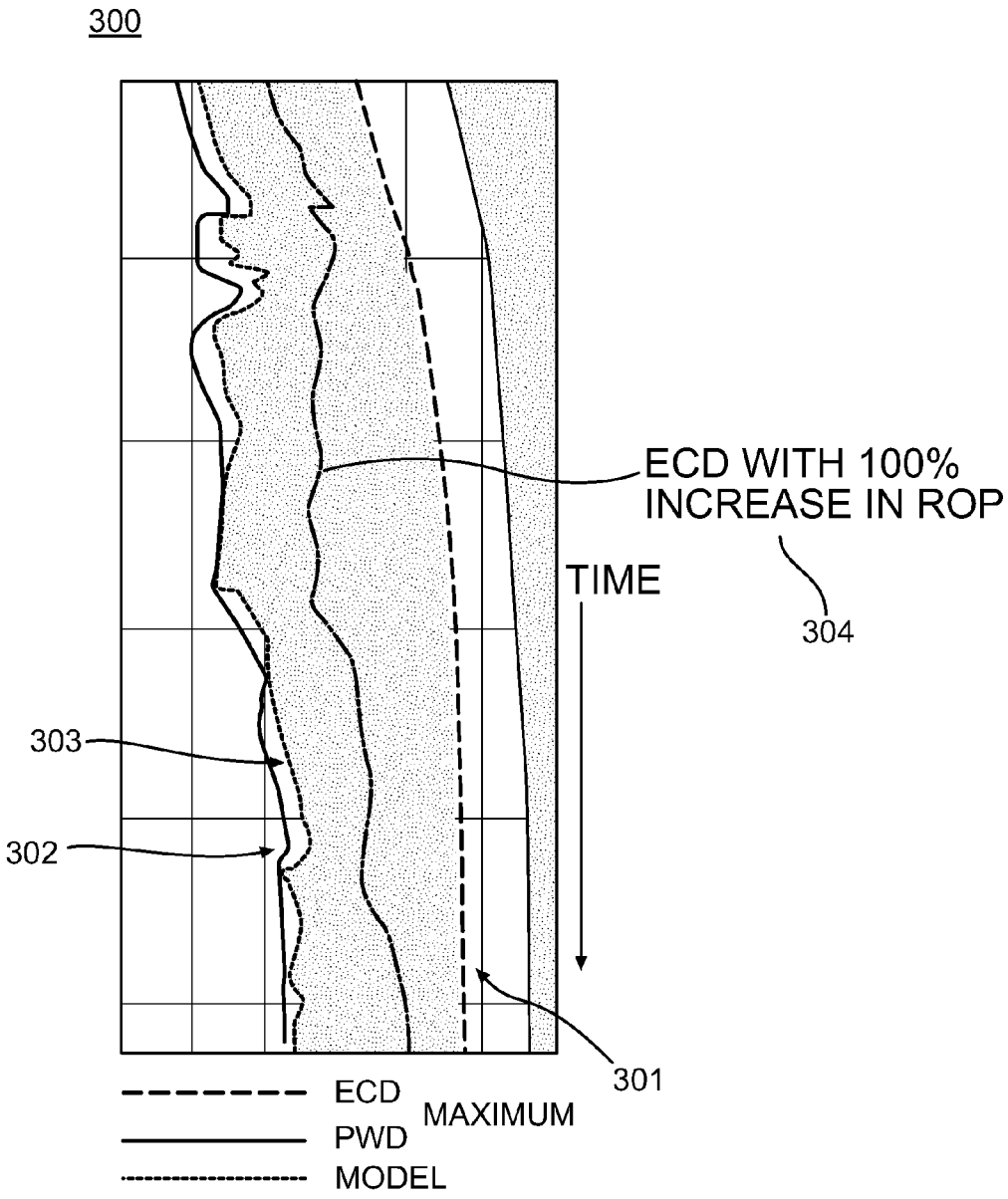
FIG. 3 is a graph which shows a hypothetical ECD if the ROP (rate-of-penetration) were increased 100% in drilling, and shows that it remains beneath the maximum ECD curve, which is beneath the fracture gradient.

Essentially, FIG. 3, shows in a strip chart 300 $ECD_{maximum}$ 301, PWD 302, and the Model data 303 as well as the ECD with the 100% increase in the rate of penetration. The $ECD_{maximum}$ 301 shows that such an increase is possible, and clearly the same depth can be safely reached in 45 minutes instead of 85 minutes.

Figure 4:
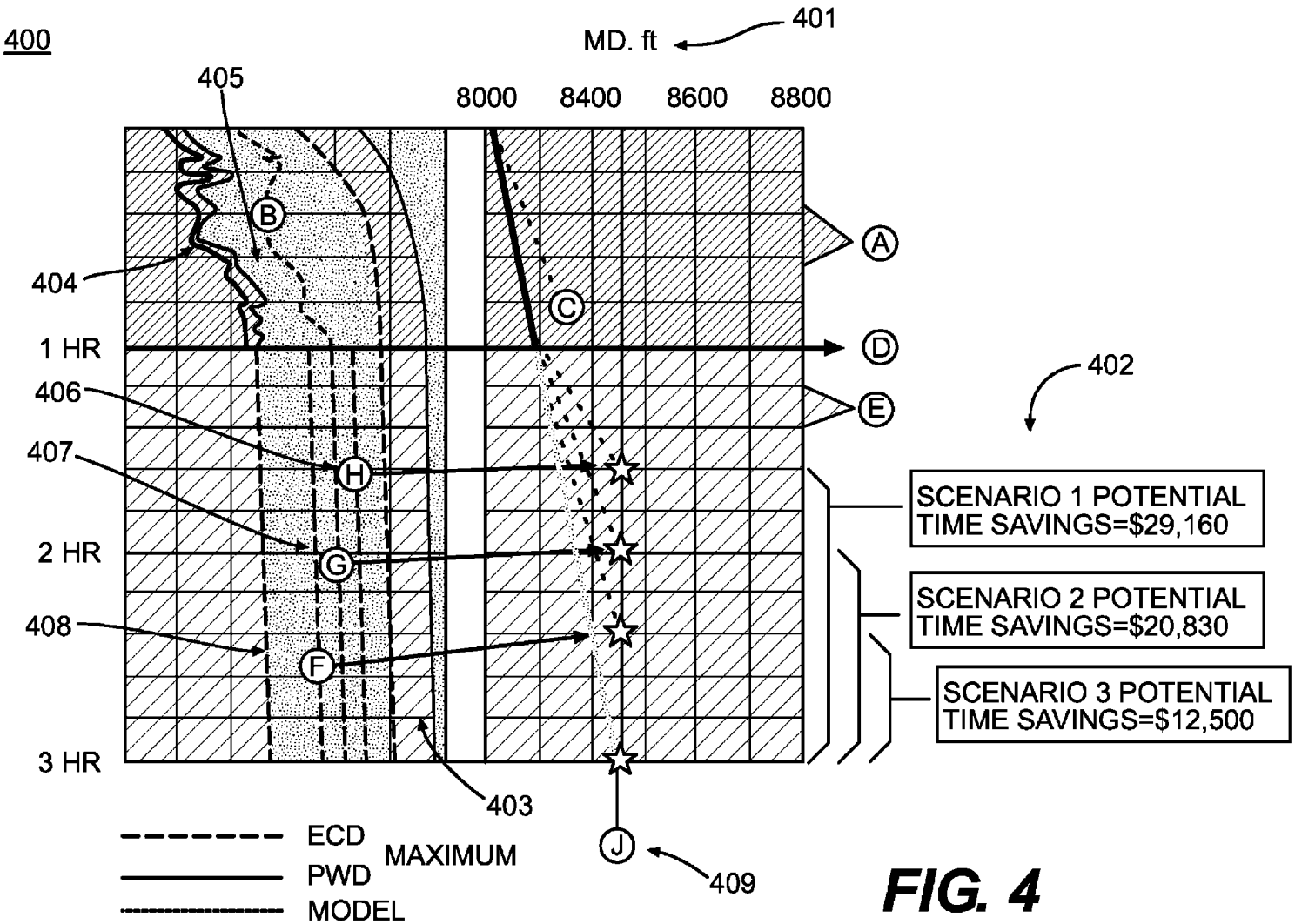
FIG. 4 is a graph which shows various time and money savings which would result from various levels of aggressiveness in drilling (i.e. various increases in ROP).

FIG. 4 represents 3 scenarios where drilling rate of penetration is progressively increased. A strip chart 400 shows MD (measured depth) 401 vs. $ECD_{maximum}$ 403, PWD 404 and Modeled ECD 405. At 402 are 3 scenarios, marked Scenarios 1, 2, and 3 which show how progressively going faster and faster (while remaining under the fracture gradient) can save $12,500; $20,830, or $29,160; depending on drilling conditions. The particular conditions underlying these increased rates of penetration are not important; the important point behind these scenarios are that the embodiments provide the user with progressively faster and faster thresholds that they may opt to implement that can lead to fast, safe drilling as long as the drilling remains within calculated limits. Thus, the embodiments suggest maximum thresholds for drilling speeds and predict what the results of drilling at intermediate drilling speeds will be. The embodiments may be designed to simply drill as fast as possible (given the limits of the rig and the borehole, or to provide the information to drillers and to allow them to choose).

Current ECD data 402 for the PWD 404, model ECD 405 and MD 401 are continuously updated as drilling progresses. FIG. 4 shows three look-ahead bit scenarios at 406, 407, 408 (F, G, H). It also shows the interval depth J 409, providing information which will allow the choice of one optimization scenario over the other.

In the table below (Table 3) is another example of how SDACE (Selective Drilling Activity Compression/Expansion) might be imposed on real-time data. In this example a 50% in ROP combined with a 25% increase in circulation (hole-cleaning) time is shown. In this case, time is saved because the drilling rate is increased. However, some time is sacrificed to hole-cleaning time. Regardless, on an offshore rig at $500,000 per day, this simple example would translate into a 17.5 minute time savings worth about $6076. Bear in mind this is only considering approximately a one hour interval. Repeated throughout a 24-hour day this would realize a savings of $145,824.

| Elapsed Time (H/M/S) | Comp/ Exp/ Elapsed Time | Status | Real ROP | Compressed ROP | Potential Time Savings |
|---|---|---|---|---|---|
| 0:00:00 | 0:00:00 | Drilling | 80 | 120 | |
| 1:00:00 | 0:40:00 | Drilling | 80 | 120 | +00:20:00 |
| 1:00:01 | 0:40:01 | Circulating | 0 | 0 | |
| 1:10:00 | 0:52:30 | Circulating | 0 | 0 | −00:02:30 |
| 1:10:01 | 0:52:31 | Drilling | | | |

Figure 5:
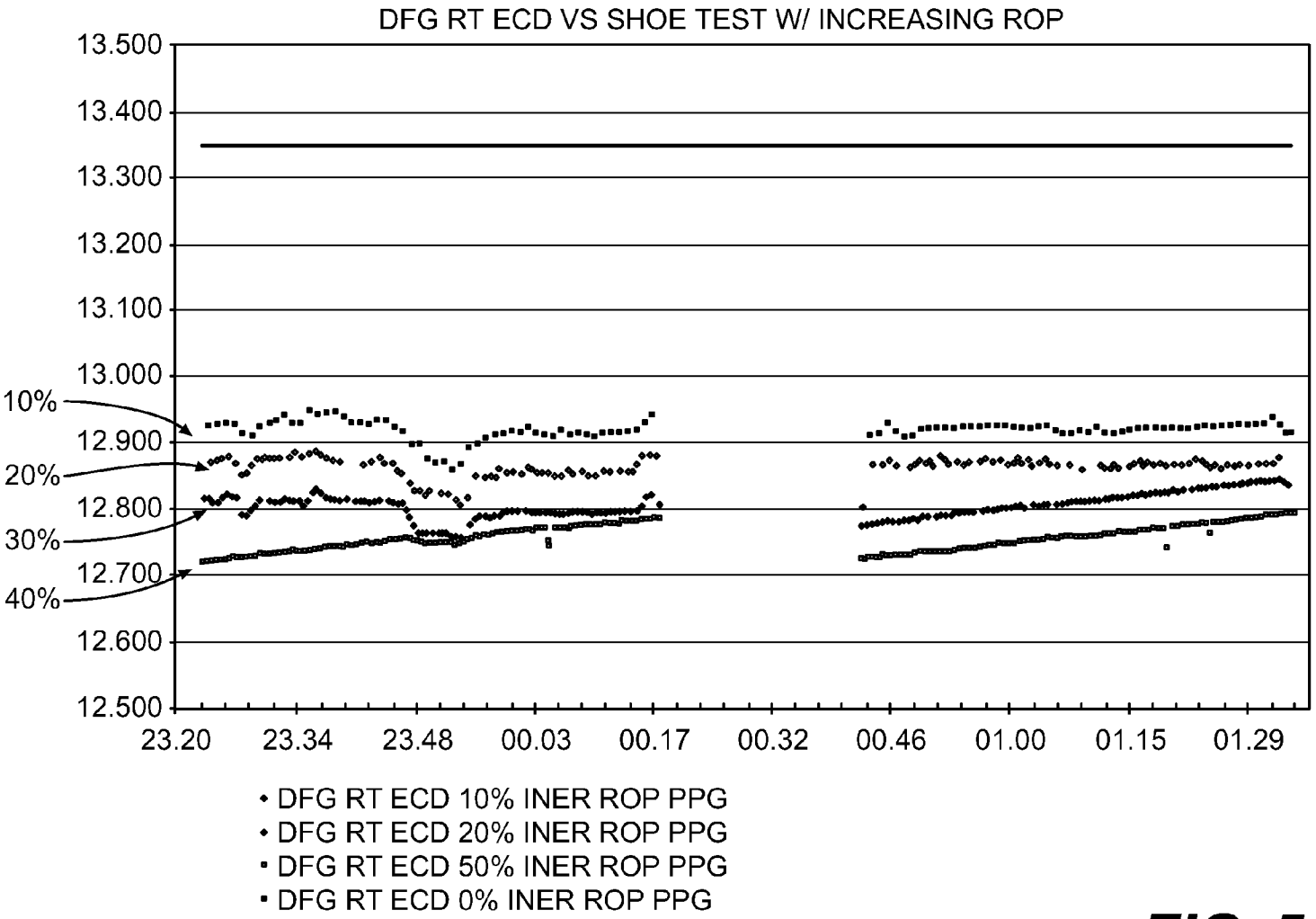
FIG. 5 is an example of actual real-time data from wells.

FIG. 5 presents a graph of expected ECD with selective time compression of the drilling process that is used to create simulations of increased ROP.

In these simulations, ROP data has been artificially increased to determine whether or not ROP could be increased and yet maintain acceptable ECD's below the fracture gradient. In this example of actual real time well data, one could have easily increased the ROP by 50% and stayed well below the fracture gradient.

Besides potential time saving, other potential costs associated with drilling can be optimized. Some of these may include, but are not limited to: mud formulation changes both with product additions and with actual system selection based on historical/offset data, mud formulation changes based on neural nets or other artificial intelligence techniques related to neural net recommendations in real-time for lubricity issues, such as torque and drag, lost circulation problems, lost circulation material maintenance, operational procedural changes, optimization of drill bit selection and bit life, coupling of weight on bit, rate of penetration, and pump rate, cuttings diameter, and low gravity solids contamination and treatment.

Figure 7:
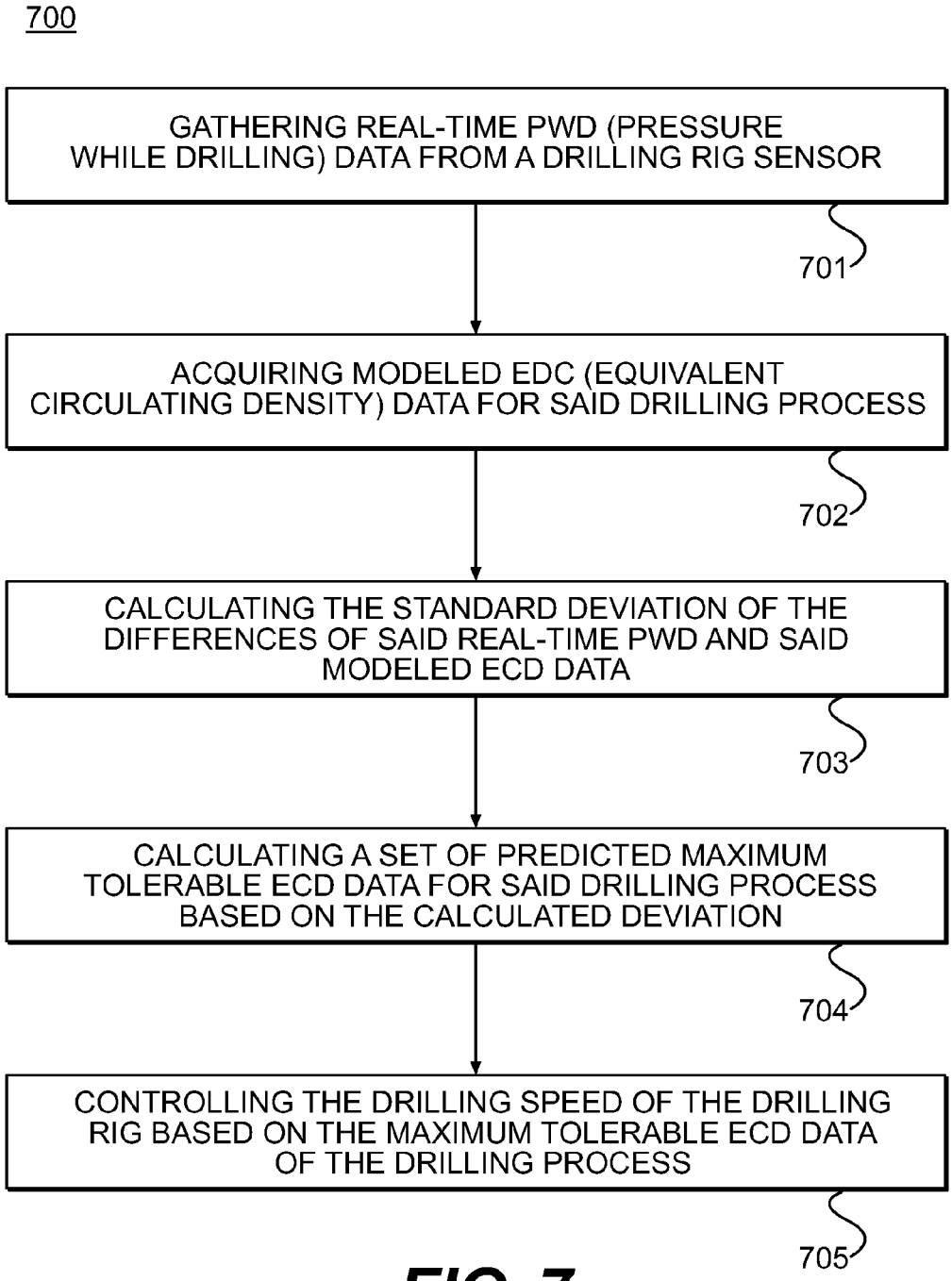
FIG. 7 is a flowchart of a method of an embodiment.

Thus, a method embodiment shown in FIG. 7 would involve gathering real-time PWD (pressure while drilling) data from a drilling rig sensor 701, acquiring modeled ECD (equivalent circulating density) data for said drilling rig 702, calculating the standard deviation of the differences of said real-time PWD and said modeled ECD data 703, and calculating a set of predicted maximum tolerable ECD data for the drilling process based on the calculated deviation 704 and determining the rate of penetration of the drilling rig based on the maximum tolerable ECD data of the drilling process 704.

Most real-time data efforts focus on managing risk, though prevention and mitigation of mistakes that cost the operator money. This invention operates, instead by capitalizing upon an unexploited opportunity. By using previously existing sources of information, the invention combines them in a novel and nonobvious use of the standard deviation between the actual and the modeled data. This technology can also be used as a training tool and post-well auditing tool.

It should be noted that the drilling optimization system 600 is illustrated and discussed herein as having various modules and units which perform particular functions and interact with one another. It should be understood that these modules and units are merely segregated based on their function for the sake of description and represent computer hardware and/or executable software code which is stored on a computer-readable medium for execution on appropriate computing hardware. The various functions of the different modules and units can be combined or segregated as hardware and/or software stored on a computer-readable medium as above as modules in any manner, and can be used separately or in combination.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

What is claimed is:

1. A method for optimizing rate of penetration when drilling into a geological formation, comprising the steps of:

gathering real-time PWD (pressure while drilling) data from sensor;

acquiring modeled ECD (equivalent circulating density) data;

calculating a standard deviation of differences between said real-time PWD and said modeled ECD data;

calculating a predicted maximum tolerable ECD based on the calculated deviation wherein said predicted maximum tolerable ECD data is based on a safety factor (SF) that is added to said standard deviation that is used as an offset from said fracture gradient (FG), further based on a reliability factor (RF) that is multiplied by said standard deviation that is used as an offset from said fracture gradient (FG); and determining using a processor, a rate of penetration of a drill string based on the maximum tolerable ECD of a drilling process.

2. The method of claim 1, wherein said predicted maximum tolerable ECD data is calculated by using said standard deviation as an offset from a fracture gradient (FG).

3. The method of claim 1, wherein said predicted maximum tolerable ECD data is based on a reliability factor (RF) that is multiplied by said standard deviation when it is used as an offset from said fracture gradient (FG).

4. The method of claim 1, wherein said predicted maximum tolerable ECD data is based on a safety factor (SF) that is added to said standard deviation when it is used as an offset from said fracture gradient (FG).

5. The method of claim 3, where the RF is based on a normal distribution of said differences.

6. The method of claim 1, further comprising the step of calculating a set of suboptimal but improved ECD values to guide said drilling speed.

7. The method of claim 1, comprising the further step of using historical data from past iterations of the method to develop at least one of: product additions for mud formulation, actual system selection, and operational procedural changes.

8. The method of claim 7, where mud formulation changes at least one of: lubricity, torque, drag, and lost circulation materials.

9. The method of claim 1, comprising the further step of selecting drill bit properties based on the rate of penetration.

10. The method of claim 1, where said determined rate of penetration is used to guide the drilling process on the drilling rig.

11. A system for optimizing rate of penetration when drilling into a geological formation, comprising:

a gathering unit for gathering real-time PWD (pressure while drilling) data;

an acquiring unit for acquiring modeled ECD (equivalent circulating density) data;

a calculating unit for calculating a standard deviation of differences between said real-time PWD and said modeled ECD data;

a calculating unit for calculating a predicted maximum tolerable ECD based on the calculated deviation wherein said predicted maximum tolerable ECD data is based on a safety factor (SF) that is added to said standard deviation that is used as an offset from said fracture gradient (FG), further based on a reliability factor (RF) that is multiplied by said standard deviation that is used as an offset from said fracture gradient (FG);

and a controlling unit for controlling a rate of penetration of a drill string based on the maximum tolerable ECD of a drilling process.

12. The system of claim 11, wherein said predicted maximum tolerable ECD data is calculated by using said standard deviation as an offset from a fracture gradient (FG).

13. The system of claim 11, wherein said predicted maximum tolerable ECD data is based on a reliability factor (RF) that is multiplied by said standard deviation when it is used as an offset from said fracture gradient (FG).

14. The system of claim 11, wherein said predicted maximum tolerable ECD data is based on a safety factor (SF) that is added to said standard deviation when it is used as an offset from said fracture gradient (FG).

15. The system of claim 14, where the RF is based on a normal distribution of said differences.

16. The system of claim 11, wherein said calculating unit calculates a set of suboptimal but improved ECD values to guide said drilling speed.

17. The system of claim 11, wherein said calculating unit uses historical data from past iterations of the method to develop at least one of product additions for mud formulation, actual system selection, and operational procedural changes.

18. The system of claim 17, where mud formulation changes at least one of lubricity, torque, drag, and lost circulation materials.

19. The system of claim 11, wherein the calculating unit selects drill bit properties based on the rate of penetration.

20. The system of claim 11, further comprising a drilling controller that uses the determined rate of penetration to guide the drilling on the drilling rig.

* * * * *

UNITED STATES PATENT AND TRADEMARK OFFICE

CERTIFICATE OF CORRECTION

PATENT NO. : 8,527,249 B2
APPLICATION NO. : 12/710445
DATED : September 3, 2013
INVENTOR(S) : Dale E. Jamison et al.

It is certified that error appears in the above-identified patent and that said Letters Patent is hereby corrected as shown below:

In the Claims

In Column 8, line 23, replace “from sensor” with --from a sensor--.

Signed and Sealed this
Twelfth Day of November, 2013

Teresa Stanek Rea

Teresa Stanek Rea
*Deputy Director of the United States Patent and Trademark Office*